US007370413B2

(12) United States Patent
Perle et al.

(10) Patent No.: US 7,370,413 B2
(45) Date of Patent: May 13, 2008

(54) METHOD OF MAKING AN ELECTRICAL CONNECTOR

(75) Inventors: Marcel Perle, Feldkirch (AT); Martin Kopf, Koblach (AT)

(73) Assignee: Hirschmann Automotive GmbH, Rankweil/Brederis (AT)

( * ) Notice: Subject to any disclaimer, the term of this patent is extended or adjusted under 35 U.S.C. 154(b) by 252 days.

(21) Appl. No.: 11/367,025

(22) Filed: Mar. 2, 2006

(65) Prior Publication Data

US 2006/0207092 A1 Sep. 21, 2006

(30) Foreign Application Priority Data

Mar. 2, 2005 (DE) ..... 10 2005 009 441

(51) Int. Cl.
*H01R 43/00* (2006.01)

(52) U.S. Cl. ..... 29/858; 29/857; 29/874; 29/877; 29/883; 439/272; 439/587; 439/589; 439/606

(58) Field of Classification Search ..... 29/858, 29/857, 874, 877, 883; 439/272, 587, 589, 439/606

See application file for complete search history.

(56) References Cited

U.S. PATENT DOCUMENTS 5,580,264 A 12/1996 Aoyama
6,443,766 B2 * 9/2002 Ichio et al. ..... 439/587
6,527,574 B1 * 3/2003 Murakami et al. ..... 439/275

FOREIGN PATENT DOCUMENTS

EP 1 122 840 8/2001
EP 1 143 580 10/2001

* cited by examiner

*Primary Examiner*—Tim Phan
(74) *Attorney, Agent, or Firm*—Andrew Wilford

(57) ABSTRACT

An electrical connector has a hard base part forming at least one rearwardly and forwardly open seat and formed with a transverse passage extending across the seat generally at the rear seat end, a respective contact in the seat having a front end and a rear end, a respective wire projecting into the rear end of the seat and connected there to the rear contact end, and a soft jacket encapsulating a rear end of the base part and front ends of the wires and extending at least partially into the rear seat ends. This connector is made by fitting a flow-blocking bar through the passage into a position blocking forward flow in the seat to the front contact end. The rear end of the part and the bar are then enclosed in a cavity of a mold to be filled with hardenable resin.

10 Claims, 3 Drawing Sheets

METHOD OF MAKING AN ELECTRICAL CONNECTOR

FIELD OF THE INVENTION

The present invention relates to an electrical connector. More particularly this invention concerns a method of making such a connector.

CROSS REFERENCE TO RELATED DOCUMENTS

This application claims priority to Germany Application No. 102005009441.4, filed on Mar. 2, 2005.

BACKGROUND OF THE INVENTION

In EP 1,122,840 of Jager and EP 1,143,580 of Jure an electrical connector is described that comprises a prefabricated dielectric base part forming two spaced rows of seats each adapted to hold a contact secured by soldering or crimping to the conductor of a respective insulated wire projecting rearwardly out of the part. The contacts can be male or female and can project forward from or be exposed forward so that the connector can be a plug or socket.

In addition this connector has as also described in U.S. Pat. No. 5,580,264 of Aoyama an integral one-piece jacket or shroud that is molded in place over the rear end of the base part and the front ends of the wires where they enter the base part. Thus this jacket serves as a strain relief and also as a rear-end seal preventing any entry of moisture into the connector along the wires from the rear. Such a connector is employed extensively in motor vehicles where it is subjected to harsh environmental conditions, vibration, dirt and, above all, moisture so that it must be rugged and very well sealed.

To further protect the connector, the base part is formed with one or more laterally open slots that are aligned with the rear crimp or solder end of the contact so that when the jacket is molded over the base part, its elastomeric material flows into the base part and encapsulates the rear end of the contact. To prevent this material from flowing forward during the injection-molding process into the contact seats and getting on the front ends of the contacts, where their metal must be exposed so that they can do their job, the mold is provided with projections that engage into the lateral slots and prevent such forward flow of the elastomer. Furthermore the mold has a part that fits between the two rows of contacts to close this gap and prevent forward flow here too.

This molding of the rear seal and strain-relief element is therefore a fairly complex process and the mold for making it has several parts. As a result, production costs for the connector, which is a mass-production item made in very high volume, are unacceptably high.

OBJECTS OF THE INVENTION

It is therefore an object of the present invention to provide an improved method of making an electrical connector.

Another object is the provision of such an improved method of making an electrical connector that overcomes the above-given disadvantages, in particular that is relatively simple but that in a simple manner produces a connector where the rear end of the prefabricated base part, the rear ends of the contacts, and the front ends of the connector wires are all thoroughly encapsulated in the soft plastic elastomer of the jacket.

SUMMARY OF THE INVENTION

An electrical connector has a hard base part forming at least one rearwardly and forwardly open seat and formed with a transverse passage extending across the seat generally at the rear seat end, a respective contact in the seat having a front end and a rear end, a respective wire projecting into the rear end of the seat and connected there to the rear contact end, and a soft jacket encapsulating a rear end of the base part and front ends of the wires and extending at least partially into the rear seat ends. This connector is made by first fitting the contact to the seat and connecting the wire to the rear contact end and then fitting a flow-blocking bar through the passage into a position blocking forward flow in the seat to the front contact end. The rear end of the part and the bar are then enclosed in a cavity of a mold, and the cavity is filled with a hardenable resin such that the resin surrounds and encapsulates the rear end of the part and flows into the seat only rearward of the flow-blocking bar.

The step of inserting the flow-blocking element or bar before molding the jacket is very simple, and allows a simple two-part mold to be used, greatly simplifying this expensive piece of equipment and substantially reducing manufacturing costs. What is more, the flow blocker, which can be of cheap injection-molded construction, can also serve to solidly pin the contacts in place, something that is particularly convenient when they are of the crimp type whose rear ends must be given considerable clearance so that they can be installed in the seats open and subsequently closed and crimped around the conductors of the wires.

According to the invention, after filling the cavity, the resin is cured to a form-stable elastomeric condition and the part and the bar are demolded. Then the bar is either left in the part or removed from it. The bar is typically made as a cheap plastic part that helps insulate the contacts from one another.

The connector in accordance with the invention has a plurality of such seats arranged in two spaced rows flanking the passage and each provided with a respective such contact each connected to a respective such wire. Furthermore it has a guide at the rear end of the base part holding the wires aligned with the seats. The guide also is enclosed in the cavity and encapsulated in the resin.

In accordance with another feature of the invention the connector further has a connector element unitary with the bar and with the guide. This connector element is not enclosed in the cavity and encapsulated in the jacket. In fact according to the invention, after demolding, the connector element is separated from the bar and from the guide. This can most effectively be done when the connector is connected at break lines to the bar and guide by snapping off the connector at the break lines.

BRIEF DESCRIPTION OF THE DRAWING

The above and other objects, features, and advantages will become more readily apparent from the following description, reference being made to the accompanying drawing in which.

SPECIFIC DESCRIPTION

Figure 1B:
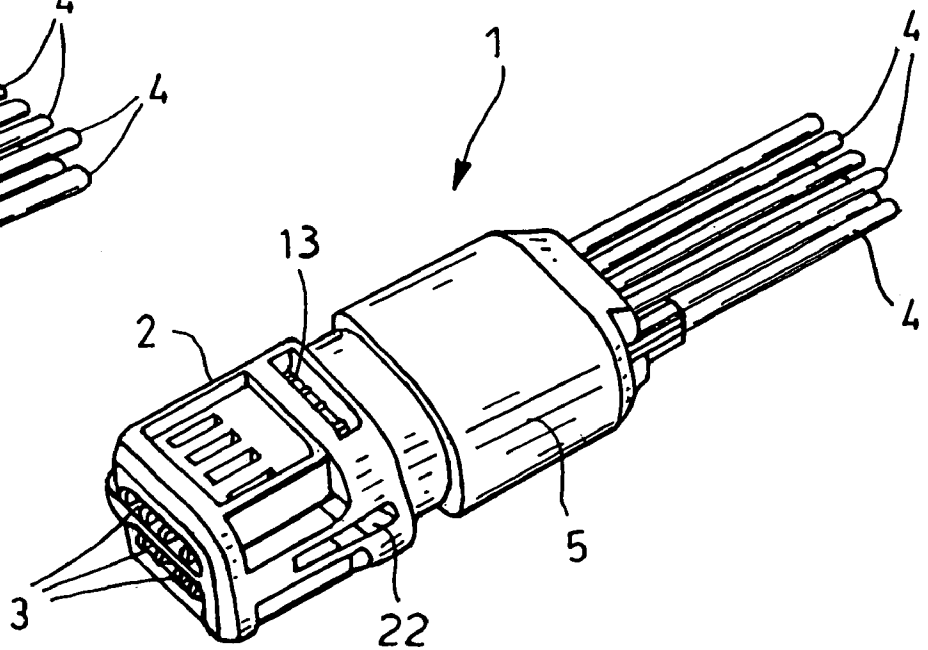
FIGS. 1A and 1B are front-end perspective views of the connector before and after molding of its jacket.

As seen in the drawing a connector 1 basically comprises a prefabricated hard-plastic base part 2 holding a plurality of contacts 3 connected to respective wires 4 and a soft-plastic or elastomeric jacket 5 that encapsulates the rear end of the base part 2, the front ends of the wires 4 where they enter the base part 2, and the rear ends of the contacts 3. The wires 4 can be separate or part of a ribbon cable.

Figure 1A:
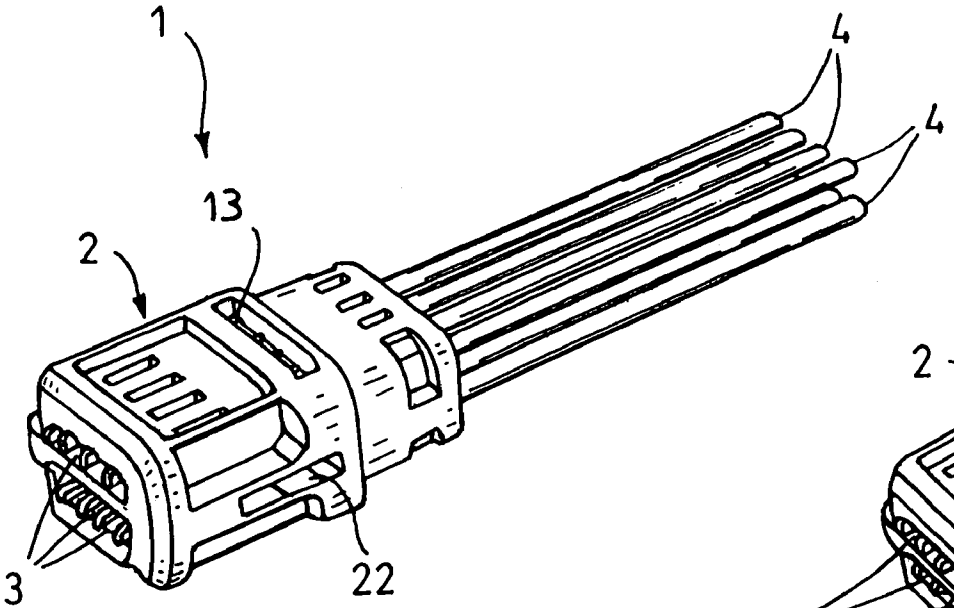
Figures 2A, 2B, 2C, 2D:
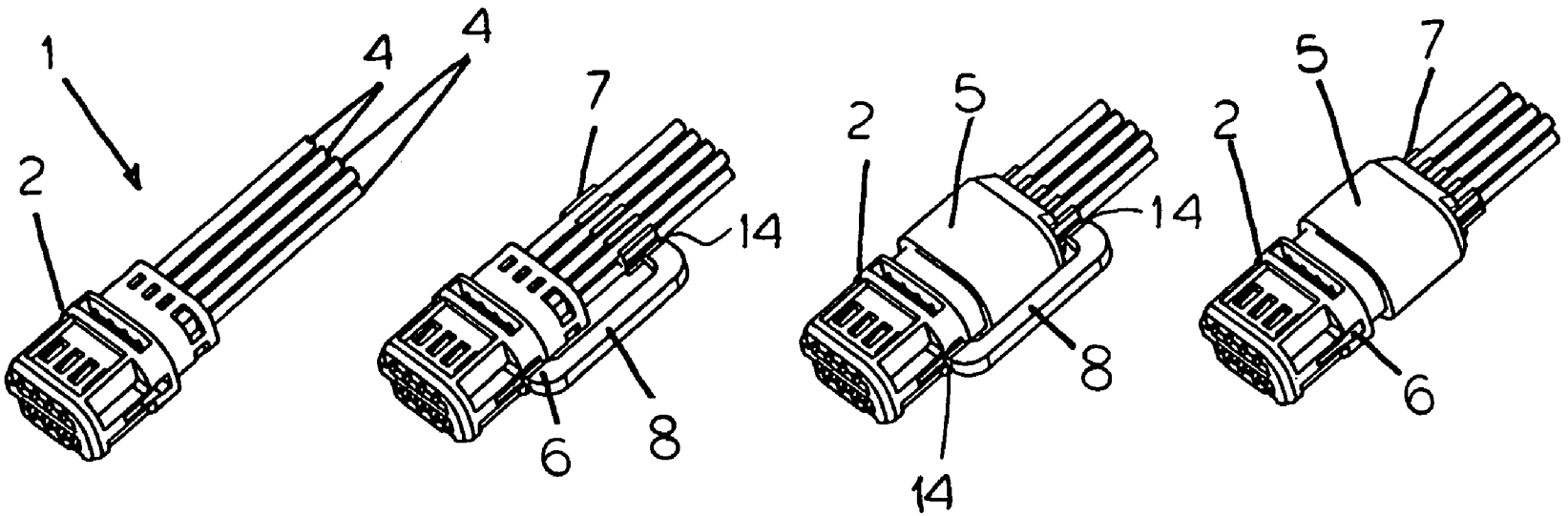
FIGS. 2A, 2B, 2C, and 2D are perspective views, with FIG. 2A generally corresponding to FIG. 1A and FIG. 2D generally corresponding to FIG. 1B, showing successive steps of making the connector according to the invention.
Figures 3A, 3B:
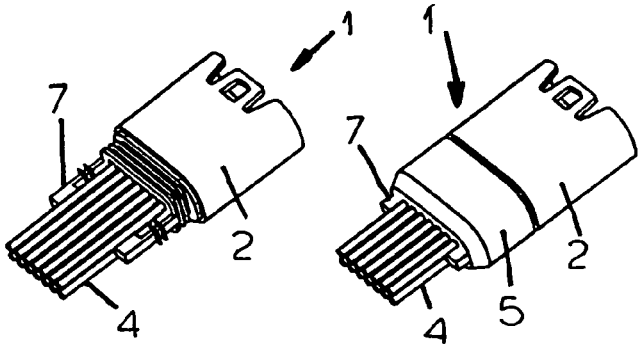
FIGS. 3A and 3B are rear-end perspective views of the connector before and after molding of its jacket.
Figure 5:
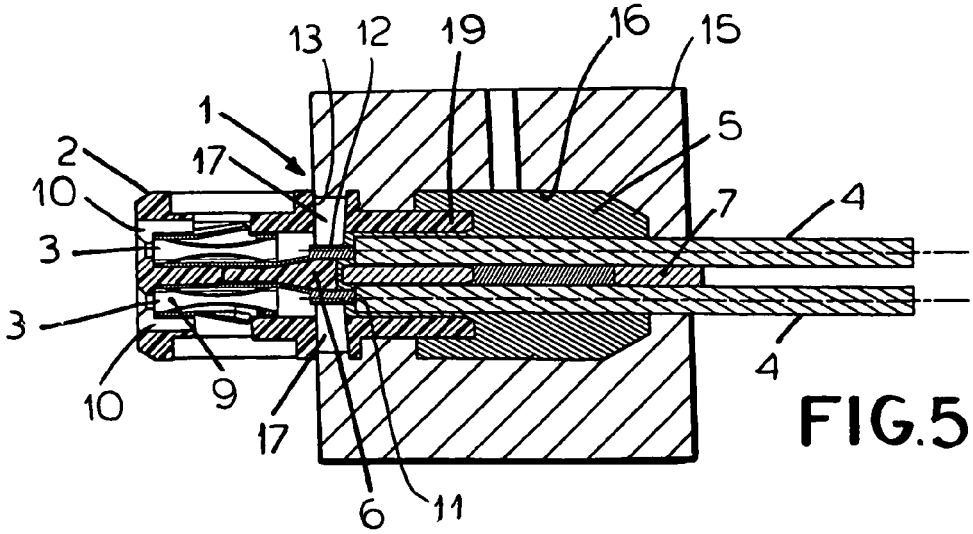
FIG. 5 is an axial or longitudinal section through the connector in a mold as it is being provided with its jacket.

More particularly the base part 2 as best seen in FIGS. 1A, 1B, and 5 is formed with two rows of seats 10, each row here having seven such seats 10. Each seat 10 in turn holds a standard metallic contact 3 having a front end 9 that can be formed as a pin or socket, here a socket, and a rear end 11 adapted to be secured to a conductor 12 of the respective wire 4, either by soldering or crimping, here by crimping. The contacts 3 therefore are arrayed in an upper and lower level at a transverse spacing from each other.

In addition the base part 2 is formed with a pair of upwardly and lower transversely open slots 13 that open into the seats at the rear ends 12 of the contacts 3. Furthermore it is formed with a laterally throughgoing and longitudinally elongated slot or passage 22 between the rows of contacts 3 and slightly forward of their rear ends 9. The wires 4 fit loosely into rearwardly open holes 17 aligned with the seats 10. The passage 22 and slots 13 allow tools to be inserted into the part 2 to connect the wires 4 to the ends 12 of the contacts 3.

Figures 4A, 4B, 4C:
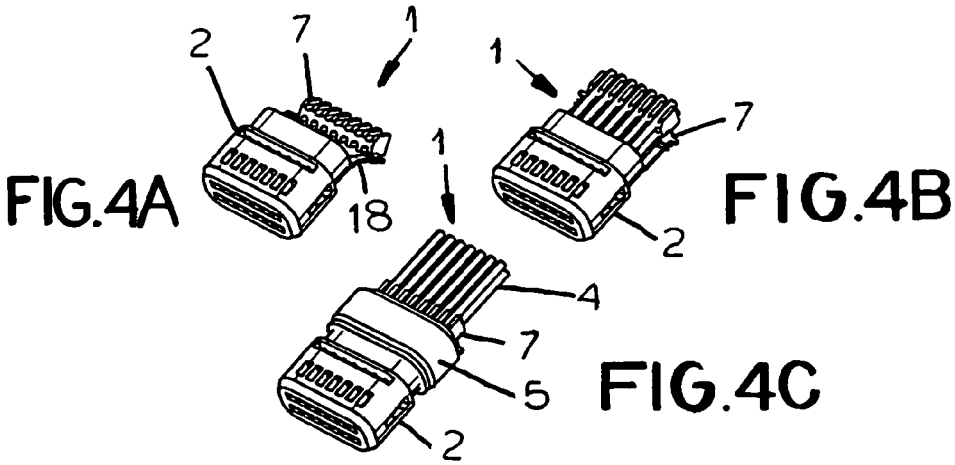
FIGS. 4A, 4B, and 4C are front-end perspective views of the connector during successive steps of manufacture and in particular illustrating how the wire guide works.

According to the invention as best seen in FIGS. 4A-4C there is also a guide 7 formed as an upwardly and downwardly open double comb adapted to fit with the rows of wires 4 rearward of the base part 2 and hold them in the desired spaced orientation. A flexible web 18 connects this guide 7 unitarily to the part 2.

This guide 7 can also be attached as shown in FIG. 2A-2D by a connector element 8 to a transverse and dielectric flow-blocking bar 6 that fits complementarily in and fills the passage 22. Front and rear score lines 14 connect the connector 6 to the comb 7 and bar 6 so that it can be removed as described below.

The connector 1 according to the invention is made in a two-part mold 15 having a cavity 16 and formed with downwardly and upwardly projecting front ridges 17 that fit in the slots 13 and bear on the upper and lower sides of forward portions of the rear ends 12 of the contacts 3.

Thus the body 5 is formed by injecting a hardenable synthetic resin int the cavity 16 so that it flows forward through the holes 17 around the wires 4 and fills the extreme rear ends of the seats 3 around the extreme rear-end portions of the contacts 3. This very solidly anchors the wires 4 in the base part 1.

Once the resin has cured, the connector 1 is demolded and the connector 8 can be broken off at the lines 14, leaving the blocking bar 6 and comb 7 imbedded in place.

We claim:

1. A method making an electrical connector having a hard base part forming at least one rearwardly and forwardly open seat and formed with a transverse passage extending across the seat generally at the rear seat end;

a respective contact in the seat having a front end and a rear end;

a respective wire projecting forwardly into the seat and connected in the seat to the rear contact end; and a soft jacket encapsulating a rear end of the base part and a front end of the wire and extending, at least partially into the rear seat end, the method comprising the steps of sequentially:

fitting the contact to the seat and connecting the wire to the rear contact end;

fitting a flow-blocking bar through the passage into a position blocking forward flow in the seat to the front contact end;

enclosing the rear end of the base part and the flow-blocking bar in a cavity of a mold; and filling the cavity with a hardenable resin such that the resin surrounds and encapsulates the rear end of the base part and flows into the seat only rearward of the flow-blocking bar.

2. The method defined in claim 1, further comprising the steps after filling the cavity of:

curing the resin to a form-stable elastomeric condition; and demolding the base part and the flow-blocking bar from the mold.

3. The method defined in claim 2, further comprising the step after demolding the base part and the flow-blocking bar of:

leaving the flow-blocking bar in the base part.

4. The method defined in claim 2, further comprising the step after demolding the base part and the flow-blocking bar of:

removing the flow-blocking bar from the base part.

5. The method defined in claim 2 wherein the connector has a plurality of such seats arranged in two spaced rows flanking the passage and each provided with a respective such contact each connected to a respective such wire.

6. The method defined in claim 5 wherein the connector further has a guide at the rear end of the base part and holding the wires aligned with the seats, the guide also being enclosed in the cavity and encapsulated in the resin.

7. The method defined in claim 6 wherein the connector further comprises a connector element unitary with the flow-blocking bar and with the guide.

8. The method defined in claim 7 wherein the connector element is not enclosed in the cavity and encapsulated in the jacket, the method further comprising the step-after demolding of: separating the connector element from the flow-blocking bar and from the guide.

9. The method defined in claim 8 wherein the connector is connected at break lines to the flow-blocking bar and guide, the separation being effected by snapping off at the break lines.

10. A method making an electrical connector having a hard base part forming a plurality of rearwardly and forwardly open seats and formed with a transverse passage extending across the seats generally at the rear seat ends;

respective contacts in the seat each having a front end and a rear end;

respective wires projecting forwardly into the seats and connected in the seats to the rear contact ends; and a soft jacket encapsulating a rear end of the base part and front ends of the wires and extending at least partially into the rear seat ends, the method comprising the steps of sequentially:

fitting the contact to the seat and connecting the wire to the rear contact end;

fitting a flow-blocking bar through the passage into a position blocking forward flow in the seat to the front contact end;

enclosing the rear end of the base part and the flow-blocking bar in a cavity of a mold; and filling the cavity with a hardenable resin such that the resin surrounds and encapsulates the rear end of the base part and flows into the seat only rearward of the flow-blocking bar.

* * * * *